US010281145B2

(12) United States Patent
Yang

(10) Patent No.: US 10,281,145 B2
(45) Date of Patent: May 7, 2019

(54) STOVE BURNER

(71) Applicant: Dongguan Hyxion Metal Technology Co., Ltd, GuangDong Province (CN)

(72) Inventor: Jinghui Yang, Guangdong Province (CN)

( * ) Notice: Subject to any disclaimer, the term of this patent is extended or adjusted under 35 U.S.C. 154(b) by 622 days.

(21) Appl. No.: 14/963,259

(22) Filed: Dec. 9, 2015

(65) Prior Publication Data

US 2017/0108215 A1 Apr. 20, 2017

(30) Foreign Application Priority Data

Oct. 14, 2015 (CN) ..... 2015 2 0796966

(51) Int. Cl.

| | |
|---|---|
| ***F24B 3/00*** | (2006.01) |
| ***F23D 14/84*** | (2006.01) |
| ***F23D 14/26*** | (2006.01) |
| ***F24C 3/08*** | (2006.01) |
| ***F23D 14/06*** | (2006.01) |

(52) U.S. Cl.

CPC ..... *F23D 14/84* (2013.01); *F23D 14/06* (2013.01); *F23D 14/26* (2013.01); *F24C 3/082* (2013.01); *F23D 2900/14062* (2013.01); *F24C 3/085* (2013.01)

(58) Field of Classification Search

CPC ..... F23D 14/84; F23D 14/06; F23D 14/26
USPC ..... 126/39 E, 39 R; 431/191–194
See application file for complete search history.

(56) References Cited

U.S. PATENT DOCUMENTS 5,947,383 A * 9/1999 Faustmann ..... F23D 14/46 239/132.3
2010/0186730 A1* 7/2010 Cadeau ..... F23D 14/06 126/39 E

* cited by examiner

*Primary Examiner* — Vivek K Shirsat
(74) *Attorney, Agent, or Firm* — Prakash Nama; Global IP Services, PLLC

(57) ABSTRACT

The present invention discloses a stove burner. The present invention, by designing the outer-ring fire cover body and the outer fire-spraying ring into two independent structures, enables the outer-ring fire cover body to be made of a heat-resisting material of low price, which reduces the manufacturing cost of the entire stove burner; besides, with the outer edge of the annular cover body plate in contact with the top of the outer fire-spraying ring and the cover body ring attached to the sidewall of the inner ring tube close to the gas inlet tube, this structure can better achieve good airtightness of the annular chamber.

9 Claims, 3 Drawing Sheets

STOVE BURNER

BACKGROUND OF THE INVENTION

The present invention relates to the field of burners, particularly to a stove burner.

A traditional stove burner comprises a base, an outer fire-spraying member, an inner-ring fire-spraying device and an igniting pin. When the outer fire-spraying member is fitted to the base, due to the problem of the manufacturing process of the outer fire-spraying member, a clearance will usually appear in a position where the outer ring cover body of the outer fire-spraying member abuts the top of the inner ring tube, and thus will cause the escape of the mixed gases in the annular chamber and may cause explosion in a severe case. For removing this clearance, the manufacturing precision of the outer fire-spraying member needs to be improved greatly, which indirectly raises the production cost.

Besides, while in operation, with the traditional outer fire-spraying member having an integral structure, due to contact with the flame, the outer ring cover body of the outer fire-spraying member needs to be made of a heat-resisting material of high price just like the outer fire-spraying ring, which results in the high manufacturing cost of the stove burner.

BRIEF SUMMARY OF THE INVENTION

The present invention provides a stove burner, which can guarantee airtightness of the annular chamber in the stove burner.

The present invention provides a spiral mixing tube gas stove, which can reduce the manufacturing cost of the stove burner.

For achieving the purpose of the present invention, the present invention adopts the following technical solution:

The stove burner of the present invention comprises a base, as well as an outer fire-spraying ring, an inner-ring fire-spraying device, an outer-ring fire cover body and an igniting pin removably mounted on the base;

the base is provided in order from the inside to the outside with a gas inlet tube, an inner ring tube and an outer ring tube that are arranged concentrically; the inner ring tube is connected to the gas inlet tube by a first plate; the bottom end of the inner ring tube is connected to the bottom end of the outer ring tube by a second plate, with the second plate provided with a mixed gas inlet; the outer fire-spraying ring, mounted at the top of the outer ring tube, is provided on its sidewall with an outer fire-spraying hole; the inner ring tube, the outer ring tube, the outer fire-spraying ring and the second plate form an annular chamber in communication with the fire gas inlet; with the outer-ring fire cover body including an annular cover body plate that seals the annular chamber, the outer edge of the annular cover body plate is in contact with the top of the outer fire-spraying ring, and the inner edge of the annular cover body plate extends and bends downward into a cover body ring, which is attached to the sidewall of the inner ring tube close to the gas inlet tube; the inner-ring fire-spraying device is mounted at the top of the gas inlet tube; and the igniting pin is inserted in an igniting-pin mounting hole of the first plate.

In one of the examples, the outer-ring fire cover body is rotatably mounted on the base; the outer-ring fire cover body is provided with an igniting hole group composed of a plurality of igniting holes, which are arranged at intervals along the radial direction of the outer-ring fire cover body; and the annular cover body plate is provided at its outer edge with an indentation corresponding to the igniting hole group.

In one of the examples, the annular chamber is provided inside with a voltage-sharing plate that, evenly provided with a plurality of voltage-sharing holes, divides the annular chamber into a first chamber in communication with the mixed gas inlet and a second chamber located above the first chamber.

In one of the examples, a deflector is provided in the first chamber at the gas outlet of the small fire gas pipe.

In one of the examples, the deflector has a first end, and a second end opposite to the first end; the first end and the second end of the deflector are located at both sides of the gas outlet of the small fire gas pipe, respectively; the first end of the deflector is connected with the first plate; and the second end of the deflector extends obliquely upward toward the direction away from the first end of the deflector.

In one of the examples, the second plate is recessed outward into a groove in a position corresponding to the deflector, and the small fire gas pipe is connected to the sidewall of the groove.

In one of the examples, it further includes a small fire gas pipe provided on the outer side of the second plate, with a gas outlet end of the small fire gas pipe in threaded connection to the mixed gas inlet and in communication with the annular chamber; and the small fire gas pipe is provided on the sidewall of its gas inlet end with at least one air inlet.

In one of the examples, the stove burner further includes a big fire gas pipe, which is in threaded connection at its gas outlet end to the bottom end of the gas inlet tube and is provided on the sidewall of its gas inlet end with at least one air inlet.

In one of the examples, the inner-ring fire-spraying device includes an inner fire-spraying ring, a fire cover holder and an inner fire ring cover plate; the fire cover holder is in threaded connection with the gas inlet tube; the inner fire-spraying ring, located in the fire cover holder, is provided on its sidewall with an inner fire-spraying hole and at its top with a threaded hole, with a screw mounted in the threaded hole; and the inner fire ring cover plate is removably arranged at the top of the inner fire-spraying ring.

In one of the examples, it further includes a fire-barrier ring sleeved at the periphery of the base, with the fire-barrier ring having a greater outer diameter at its top than at its bottom.

The stove burner of the present invention has the following advantages compared with the prior art: The present invention, by designing the outer-ring fire cover body and the outer fire-spraying ring into two independent structures, enables the outer-ring fire cover body to be made of a heat-resisting material of low price instead of the heat-resisting material of high price used for the outer fire-spraying ring, which reduces the manufacturing cost of the entire stove burner. Besides, with the outer edge of the annular cover body plate in contact with the top of the outer fire-spraying ring and the cover body ring attached to the sidewall of the inner ring tube close to the gas inlet tube, even if there is a clearance between the outer-ring fire cover body and the inner ring tube, the gas needs a bent channel to escape; compared to the traditional case where the outer ring cover body of the outer fire-spraying member is in direct contact with the top of the inner ring tube and sealed, this structure can better achieve good airtightness of the annular chamber, without the need for high precision and with the reduced manufacturing cost.

LIST OF REFERENCE NUMBERS IN THE FIGURES

10. A stove burner;

20. a base; 21. a gas inlet tube; 22. an inner ring tube; 23. an outer ring tube; 231. a step; 24. a first plate; 241. an igniting-pin mounting hole; 25. a second plate; 251. a groove; 26. a voltage-sharing plate; 27. a deflector; 28. a first chamber; 29. a second chamber;

30. a fire-barrier ring;

40. an outer fire-spraying ring; 41. an outer fire-spraying hole;

50. an outer-ring fire cover body; 51. a cover body ring; 52. an annular cover body plate; 53. an igniting hole group; 54. an indentation;

60. an inner-ring fire-spraying device; 61. a fire cover holder; 62. an inner fire-spraying ring; 621. an inner fire-spraying hole; 63. an inner fire ring cover plate; 64. a screw;

70. an igniting pin;

80. a small fire gas pipe; 81. an air inlet;

90. a big fire gas pipe; and 91. a mixed gas inlet.

DETAILED DESCRIPTION OF THE INVENTION

In order to facilitate understanding of the present invention, the present invention will be described below more adequately with reference to the relevant figures. The preferred examples of the present invention are given in the figures. However, the present invention can be implemented in many different forms, and is not limited to the examples described herein. On the contrary, these examples are provided for the purpose of making the disclosure of the present invention understood more thoroughly and comprehensively.

It should be noted that, when an element is referred to as "fixed" to another element, it can be located directly on another element or there can also be an element located between them. When an element is considered to be "connected to" another element, it can be connected directly to another element or there can also be an element located between them.

Figure 1:
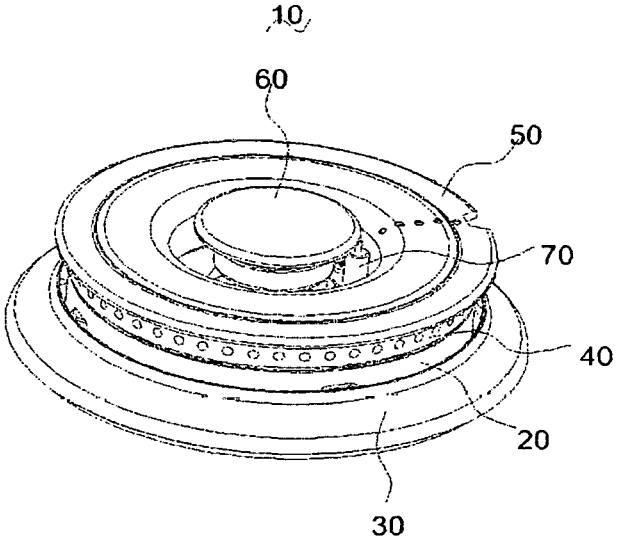
FIG. 1 is a schematic diagram of the three-dimensional structure of the stove burner of the example of the present invention.
Figure 2:
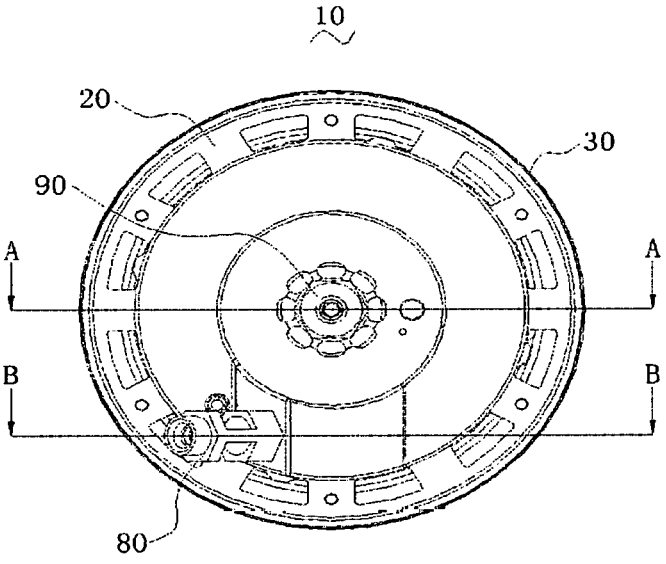
FIG. 2 is a schematic diagram of the stove burner in FIG. 1 viewed from another direction.
Figure 3:
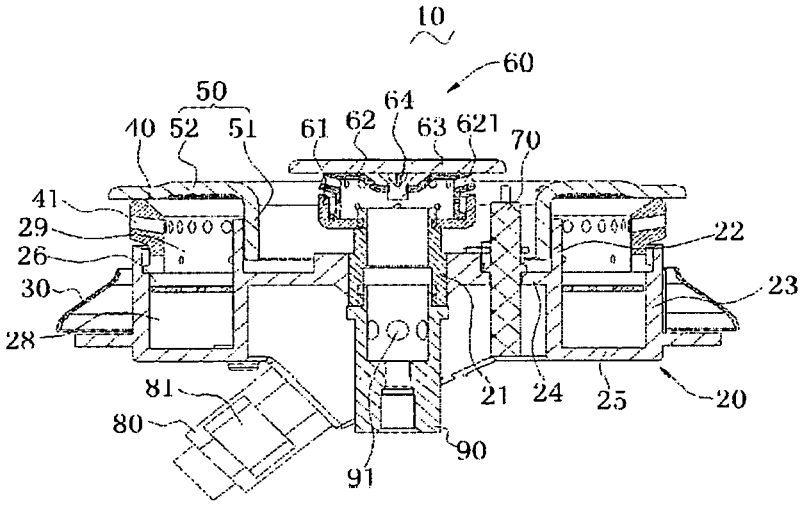
FIG. 3 is a sectional view of FIG. 2 along a line A-A.
Figure 4:
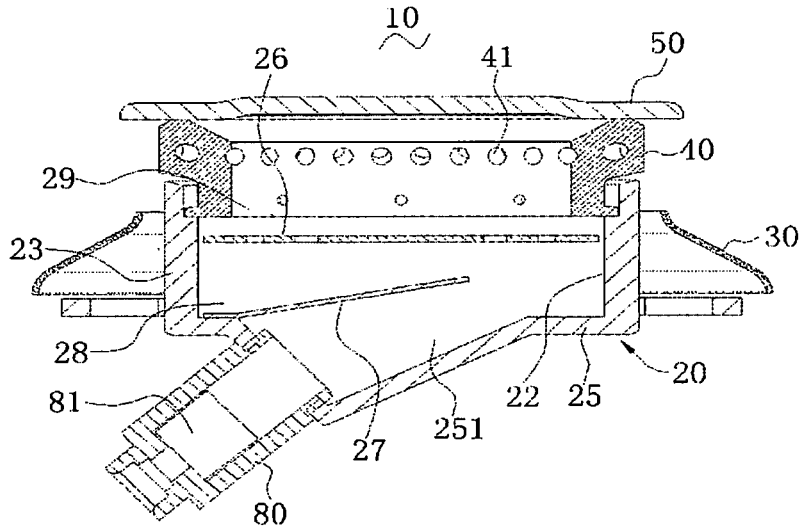
FIG. 4 is a sectional view of FIG. 2 along a line B-B.
Figure 5:
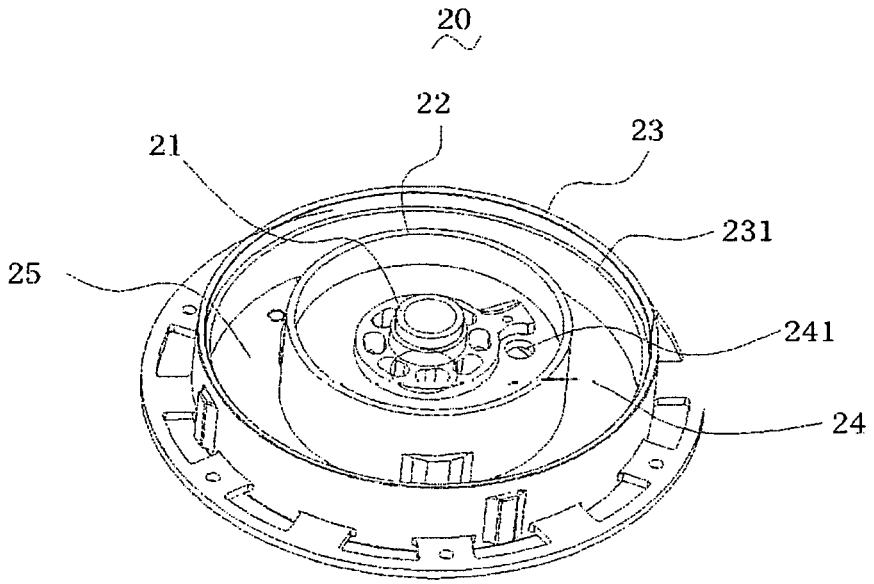
FIG. 5 is a schematic diagram of the structure of the base of the stove burner in FIG. 1.

As shown in FIGS. 1-6, the present invention discloses a preferred stove burner 10, which comprises a base 20, as well as an outer fire-spraying ring 40, an inner-ring fire-spraying device 60, an outer-ring fire cover body 50 and an igniting pin 70 removably mounted on the base 20; as shown in FIG. 5, the base 20 is provided in order from the inside to the outside with a gas inlet tube 21, an inner ring tube 22 and an outer ring tube 23 that are arranged concentrically; the inner ring tube 22 is connected to the gas inlet tube 21 by the first plate 24; the inner ring tube 22 is connected to the outer ring tube 23 by the second plate 25, which is provided with a mixed gas inlet; as shown in FIG. 1, the outer fire-spraying ring 40, mounted at the top of the outer ring tube 23, is provided on its sidewall with an outer fire-spraying hole 41; the inner ring tube 22, the outer ring tube 23, the outer fire-spraying ring 40 and the second plate 25 form an annular chamber in communication with the fire gas inlet; with the outer-ring fire cover body 50 including an annular cover body plate 52 that seals the annular chamber, the outer edge of the annular cover body plate 52 is in contact with the top of the outer fire-spraying ring 40, and the inner edge of the annular cover body plate 52 extends and bends downward into a cover body ring 51, which is attached to the sidewall of the inner ring tube 22 close to the gas inlet tube 21; the inner-ring fire-spraying device 60 is mounted at the top of the gas inlet tube 21; and the igniting pin 70 is inserted in an igniting-pin mounting hole 241 of the first plate 24.

By designing the outer-ring fire cover body 50 and the outer fire-spraying ring 40 into two independent structures, the present invention enables the outer-ring fire cover body 50 to be made of a heat-resisting material of low price instead of the heat-resisting material of high price used for the outer fire-spraying ring 40, which reduces the manufacturing cost of the entire stove burner 10; besides, with the outer edge of the annular cover body plate 52 in contact with the top of the outer fire-spraying ring 40 and the cover body ring 51 attached to the sidewall of the inner ring tube 22 close to the gas inlet tube 21, even if there is a clearance between the outer-ring fire cover body 50 and the inner ring tube 22, the gas needs a bent channel to escape; compared to the traditional case where the outer ring cover body of the outer fire-spraying member is in direct contact with the top of the inner ring tube and sealed, this structure can better achieve good airtightness of the annular chamber, without the need for high precision and with the reduced manufacturing cost.

Figure 6:
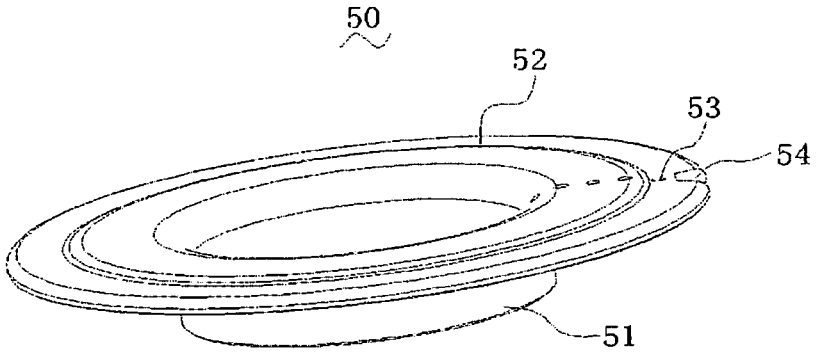
FIG. 6 is a schematic diagram of the structure of the outer-ring fire cover body of the stove burner in FIG. 1.

The outer-ring fire cover body 50 is rotatably mounted on the base 20; as shown in FIG. 6, the outer-ring fire cover body 50 is provided with an igniting hole group 53 composed of a plurality of igniting holes, which are arranged at intervals along the radial direction of the outer-ring fire cover body 50; and the annular cover body plate 52 is provided at its outer edge with an indentation 54 corresponding to the igniting hole group 53.

By arranging the igniting holes at intervals along the radial direction of the outer-ring fire cover body 50 and providing the outer-ring fire cover body 50 at its edge with an indentation 54 corresponding to the igniting hole group 53, the fire sprayed by the inner-ring fire-spraying device 60 can ignite the igniting hole nearby and, under the action of the fire sprayed by this igniting hole, other igniting holes are ignited in order, such that the fire is led to the indentation 54 and goes through the indentation 54 to finally ignite the outer fire-spraying hole 41 on the sidewall of the outer fire-spraying ring 40 in order; with the outer-ring fire cover body 50 rotatably mounted on the base 20, the igniting hole group 53 can also rotate along with the outer-ring fire cover body 50, which enables the igniting hole group 53 to rotate to the most favorable position to get ignited, so as to quickly ignite the igniting hole group 53 and then the outer fire-spraying ring 40.

In this example, the outer ring tube 23 is provided on its sidewall near the inner ring tube 22 with a step 231, which the bottom end of the outer fire-spraying ring 40 abuts.

As shown in FIGS. 1 and 3, the annular chamber is provided inside with a voltage-sharing plate 26 that, evenly provided with a plurality of voltage-sharing holes, divides the annular chamber into a first chamber 28 in communication with the mixed gas inlet and a second chamber 29 located above the first chamber 28.

By providing a voltage-sharing plate 26 in an annular chamber formed by the outer fire-spraying ring 40, the outer ring tube 23, the inner ring tube 22 and the second plate 25, the mixed gases entering the annular chamber are uniformly dispersed to have lower pressure, which enables the outer fire-spraying ring 40 to spray uniform flames and enables the mixed gases in the outer fire-spraying ring 40 to burn adequately.

As shown in FIG. 4, a deflector 27 is provided in the first chamber 28 at the gas outlet of the small fire gas pipe 80. By providing the deflector 27 in the first chamber 28 at the gas outlet of the small fire gas pipe 80, the gas sprayed out of the gas outlet of the small fire gas pipe 80 cannot enter the outer fire-spraying ring 40 directly through the voltage-sharing plate 26 but, under the action of the deflector 27, after running for a period of time, enters the outer fire-spraying ring 40 through the voltage-sharing plate 26, which makes the mixed gases detained in the annular chamber for a longer period of time, conducive to adequate mixing of the air and fuel gas in the mixed gases, improving the fuel gas combustion rate.

Specifically, the deflector 27 has a first end, and a second end opposite to the first end; the first end and the second end of the deflector are located at both sides of the gas outlet of the small fire gas pipe 80, respectively; the deflector is connected at its first end with the first plate 24; and the second end of the deflector extends obliquely upward toward the direction away from the first end of the deflector.

The second plate 25 is recessed outward into a groove 251 in a position corresponding to the deflector 27, and the small fire gas pipe 80 is connected to the sidewall of the groove 251. With the groove 251, the mixed gases are reduced in pressure before entering the annular chamber, which facilitates further reduction of the pressure of the mixed gases by the auxiliary voltage-sharing plate 26, so as to make the mixed gases burn adequately.

The stove burner 10 further includes a small fire gas pipe 80 provided at the outer side of the second plate 25, with the gas outlet end of the small fire gas pipe 80 in threaded connection to the mixed gas inlet and in communication with the first chamber 28; in order to enable the fuel gas fed into the small fire gas pipe 80 to be mixed with air adequately, the small fire gas pipe 80 is provided on the sidewall of its gas inlet end with at least one air inlet 81. In this example, there are two air inlets 81, which are distributed uniformly around the central axis of the small fire gas pipe 80.

The stove burner 10 further includes a big fire gas pipe 90, which is in threaded connection at its gas outlet end to the bottom end of the gas inlet tube 21 and provided on the sidewall of its gas inlet end with at least one air inlet 81. In this example, there are 6 mixed gas inlets 91, which are distributed uniformly around the central axis of the big fire gas pipe 90.

The inner-ring fire-spraying device 60 includes an inner fire-spraying ring 62, a fire cover holder 61 and an inner fire ring cover plate 63; the fire cover holder 61 is in threaded connection with the gas inlet tube 21; the inner fire-spraying ring 62, located in the fire cover holder 61, is provided on its sidewall with an inner fire-spraying hole 621 and at its top with a threaded hole, with a screw 64 mounted in the threaded hole; and the inner fire ring cover plate 63 is removably arranged at the top of the inner fire-spraying ring 62. With the existing inner fire-spraying ring 62 having a less mass, if the pressure of the mixed gases in the inner fire-spraying ring 62 is too high, the inner fire-spraying ring 62 may jump off the fire cover holder 61; by providing the inner fire ring cover plate 63 at the top of the inner fire-spraying ring 62, certain pressure is applied to the inner fire-spraying ring 62, thus making the inner fire-spraying ring 62 not jump off the fire cover holder 61 so easily due to the pressure of the mixed gases.

In order to prevent the stove used for mounting the stove burner 10 from being burnt by the fire produced by the stove burner 10, the stove burner 10 further includes a fire-barrier ring 30 sleeved at the periphery of the base 20, with the fire-barrier ring 30 having a greater outer diameter at its top than at its bottom.

In order to facilitate processing of the base 20, the gas inlet tube 21, the outer ring tube 23, the inner ring tube 22, the first plate 24 and the second plate 25 are made into an integral structure.

The operational principle of the stove burner 10 of this example is as follows:

When the fuel gas valve is switched to the big fire position, the fuel gas will be sprayed out of a nozzle, and then enters the stove burner 10 through two routes, respectively.

Route 1: The mixed gases formed by the fuel gas and air enter the gas inlet tube 21 through the big fire gas pipe 90; finally, the mixed gases in the gas inlet tube 21 are sprayed out of the inner fire-spraying ring 62, and then ignited by an electric spark produced by the igniting pin 70, with the igniting hole group 53 ignited by the fire produced by the inner fire-spraying ring 62 at the same time.

Route 2: The mixed gases formed by the fuel gas and air enter the groove 251 through the small fire gas pipe 80, and then enter the first chamber 28 under the action of the deflector 27, and finally enter the second chamber 29 under the action of uniform dispersion of the voltage-sharing plate 26, thus forming mixed gases with uniform pressure; here the pressure of the mixed gases in the second chamber 29 has been reduced relative to that of the mixed gases in the first chamber 28; finally, the mixed gases in the second chamber 29 are sprayed out of the outer fire-spraying ring 40, and then ignited by the fire produced by the igniting hole group 53.

The above examples are merely expression of several embodiments of the present invention. They are described specifically and in detail, but cannot therefore be construed as limiting the patent scope of the present invention. It should be noted that, for those skilled in the art, a number of modifications and improvements can also be made without departing from the principle of the present invention, and belong to the scope of protection of the present invention. Therefore, the scope of protection of the present invention should be subject to the appended claims.

What is claimed is:

1. A stove burner, comprising a base, an outer fire-spraying ring, an inner-ring fire-spraying device, an outer-ring fire cover body and an igniting pin removably mounted on the base;

the base is provided sequentially from inside to outside with a gas inlet tube, an inner ring tube and an outer ring tube that are arranged concentrically; the inner ring tube is connected to the gas inlet tube by a first plate; a bottom end of the inner ring tube is connected to a bottom end of the outer ring tube by a second plate, the second plate is provided with a mixed gas inlet; the outer fire-spraying ring, mounted at a top side of the outer ring tube, is provided on a sidewall thereof with an outer fire-spraying hole; the inner ring tube, the outer ring tube, the outer fire-spraying ring and the second plate form an annular chamber in communication with a first fire gas inlet; the outer-ring fire cover body comprises an annular cover body plate that seals the annular chamber; an outer edge of the annular cover body plate is in contact with a top side of the outer fire-spraying ring, and an inner edge of the annular cover body plate extends and bends downward defining a cover body ring, which is attached to a sidewall of the inner ring tube; the inner-ring fire-spraying device is mounted at a top side of the gas inlet tube; and the igniting pin is inserted in an igniting-pin mounting hole of the first plate;

the stove burner further comprises a first fire gas pipe, which is in threaded connection at a gas outlet end thereof to a bottom end of the gas inlet tube; the outer-ring fire cover body is rotatably mounted on the base; the outer-ring fire cover body is provided with an igniting hole group composed of a plurality of igniting holes, which are arranged at intervals along a radial direction of the outer-ring fire cover body; the annular cover body plate is provided at an outer edge thereof with an indentation corresponding to the igniting hole group.

2. The stove burner according to claim 1, wherein the annular chamber is provided inside with a holed plate evenly provided with a plurality of holes, the holed plate divides the annular chamber into a first chamber in communication with the mixed gas inlet and a second chamber located above the first chamber.

3. The stove burner according to claim 2, wherein a deflector is provided in the first chamber at a gas outlet of a second fire gas pipe.

4. The stove burner according to claim 3, wherein the deflector has a first end, and a second end opposite to the first end; the first end and the second end of the deflector are located at two sides of the gas outlet of the second fire gas pipe respectively; the first end of the deflector is connected with the first plate; and the second end of the deflector extends obliquely upward away from the first end of the deflector.

5. The stove burner according to claim 3, wherein the second plate is recessed to define a groove in a position corresponding to the deflector, and the second fire gas pipe is connected to a sidewall of the groove.

6. The stove burner according to claim 1, further comprising a second fire gas pipe provided on an outer side of the second plate; a gas outlet end of the second fire gas pipe is in communication with the annular chamber; and the second fire gas pipe is provided on a sidewall of a gas inlet end thereof with at least one air inlet.

7. The stove burner according to claim 2, further comprising a second fire gas pipe provided on an outer side of the second plate; a gas outlet end of the second fire gas pipe is in communication with the annular chamber; and the second fire gas pipe is provided on a sidewall of a gas inlet end thereof with at least one air inlet.

8. The stove burner according to claim 1, wherein the inner-ring fire-spraying device comprises an inner fire-spraying ring, a fire cover holder and an inner fire ring cover plate; the fire cover holder is in threaded connection with the gas inlet tube; the inner fire-spraying ring, located in the fire cover holder, is provided on a sidewall thereof with an inner fire-spraying hole and at a top side thereof with a threaded hole; a screw is mounted in the threaded hole; the inner fire ring cover plate is removably arranged at the top side of the inner fire-spraying ring.

9. The stove burner according to claim 1, further comprising a fire-barrier ring sleeved at a periphery of the base; an outer diameter of a top side of the fire-barrier ring Is greater than an outer diameter of a bottom side of the fire-barrier ring.

* * * * *